US006969699B1

(12) United States Patent
Sen et al.

(10) Patent No.: US 6,969,699 B1
(45) Date of Patent: Nov. 29, 2005

(54) DETERGENT-FREE SCOURING COMPOSITION

(75) Inventors: Raja Sen, Dhanbad (IN); Ujjal Bhattacharjee, Chandigarh (IN); Deba Priya Choudhury, Dhanbad (IN); Lakshmi Narayan Nandi, Dhanbad (IN); Saikat Maitra, Dhanbad (IN)

(73) Assignee: Council of Scientific & Industrial Research (IN)

( * ) Notice: Subject to any disclaimer, the term of this patent is extended or adjusted under 35 U.S.C. 154(b) by 0 days.

(21) Appl. No.: 10/107,613

(22) Filed: Mar. 28, 2002

(51) Int. Cl.[7] ..... C11D 17/00

(52) U.S. Cl. ..... 510/218; 236/240; 236/368; 236/424; 236/509; 134/7; 134/25.2

(58) Field of Search ..... 134/7, 25.2; 510/218, 510/219, 235, 236, 240, 368, 509, 429

(56) References Cited

U.S. PATENT DOCUMENTS 5,990,067 A * 11/1999 Franssen et al. ..... 510/240

* cited by examiner

*Primary Examiner*—Necholus Ogden
(74) *Attorney, Agent, or Firm*—Gauthier & Connors LLP

(57) ABSTRACT

The present invention provides a low foaming scouring powder composition, said composition comprising fly ash as an abrasive agent ranges between 40 and 75%, an surfactant ranges between 3 and 6%, an alkali metal carbonate ranges between 10 and 20 %, an alkali metal bicarbonate ranges between 3 and 15%, an alkali halide ranges between 1 and 10 %, clay ranges between 5 to 50% and optionally traces of perfumes and colors and a process for preparing the above said composition.

4 Claims, No Drawings

DETERGENT-FREE SCOURING COMPOSITION

FIELD OF THE INVENTION

The present invention relates to a cleaning powder composition and a process thereof. The present invention more specifically relates to a scouring powder composition, 'Glitters', wherein fly ash, a waste product from thermal power stations, is utilized as an abrasive agent. This invention finds its usage as cleaning powder; especially used for removing stains/scorch marks and burnt-on dirt deposited over kitchen utensils and industrial vessels.

BACKGROUND AND PRIOR ART REFERENCES

Scouring powders are among the oldest and, even today, still indispensable cleaning materials, which are used both in kitchens and in industries for removing obstinate soils. The basic constituents of scouring powders are, on one hand, the abrasive particles required for mechanically loosening obstinate soil and, on the other hand, surfactants as surface-active agents which are essential for the removal of greasy or fat-containing dirt. The scouring powders currently available in the market contain mostly alkylbenzene sulphonates as surfactants and, from case to case, other active substances and auxiliaries such as, for example, bleaches and disinfectants, zeolites and alkaline salts. German patent applications DE 2539733 A1 and DE 2739776 A1 (Procter & Gamble) describe scouring liquids and powders in which the abrasive consists of perlite in a quantity of up to 65%. These patents refer mainly to this special abrasive and mention sulfates and alkyl-benzene sulphonates as surfactants for the powders. Canadian Patent 1048365 (Procter & Gamble) describes abrasive powders having a high surfactant content of 20 to 35% and an abrasive content of 5 to 20% which are recommended both as scouring powders and an dishwashing detergents. A common feature of the scouring powders known from the literature and available in the market is that they have a good cleaning effect with respect to greasy and fat-containing soil, but foam to an undesirably high degree in use. To avoid foaming, attempts have even been made to market pure abrasives without any addition of surfactants. However, scouring powders such as these do not remove grease and in addition, behave totally unsatisfactorily in use because they cannot be dispersed. Hitherto, it has not been possible to satisfy consumer demand for low-foaming scouring powders with a good cleaning effect. In no case, fly ash was used as an abrasive. Fly ash, a primary product of coal utilization, is obtained as a fine particulate mineral residue, left behind after all combustibles in coal are burnt out. Its current output rate from steam raising and other plants utilizing pulverized coal, is about 100 million tones per annum. Its accumulation without adequate avenues for consumption or disposal otherwise, creates firstly the problem of space for its storage. Secondly, air polluted by its silica particles of less than 10 microns size emitted by boiler chimneys or carried away by prevailing winds from open heaps, causes breathing trouble to human beings. There is a pressing need felt by planners and operators of power stations, to search new areas of its usage, so that the twin problems of its storage and pollution could be mitigated to a considerable extent. Having no easy solution for transportation to outskirts, it is being piled up everyday. The subject of the invention is to prepare a scouring composition wherein the abrasive action of fly ash is utilized. Prior art search for fly ash based scouring powder compositions was made based on literature survey and patent databases, which did not yield any relevant references.

In U.S. Pat. No. 5,990,067 fly ash is not an essential component as it clearly and repeatedly states that the remainder of the formulation comprises any one out of: fly ash, port land cement, kiln dust or mixtures thereof. However in our case, fly ash is the main and essential ingredient, which acts as the abrasive agent.

In U.S. Pat. No. 5,990,067 quartz (in form of powdered quartz sand) is an active ingredient, which acts as abrasive agent. However in our case, the abrasive agent is fly ash instead of quartz, which is the most commonly used abrasive agent in convention scouring powders. Fly ash is a much more occupationally safer material than quartz as grinding quartz to desired fine size is an occupationally hazardous operation as it is associated with silicosis. Since fly ash is already in finely divided state, the hazardous operation of grinding is avoided. Thus in the case of the present invention fly ash is replacing quartz and not complementing it as is the case in U.S. Pat. No. 5,990,067. In the U.S. Pat. No. 5,990,067, fly ash if added is not an active ingredient but as a filler and weight increasing agent. However in our invention, fly ash is the main active ingredient while the rest provide supporting roles. In our case, we have not used any detergent in comparison to the referred patent.

The U.S. Pat. No. 5,990,067 is specifically meant for cleaning oil stains from concrete and asphalt surfaces, such as pavements, car parking lots, whereas the present invention is a hard scouring cleaning powder for cleaning burnt-on stains and dirt on metal surfaces such as scorch marks on a metal cooking utensil. The composition in the U.S. Pat. No. 5,990,067 is distributed on the oil stain on the concrete surface, dampened with mist of water and spread with only enough rubbing or mechanical action so as the formulation is worked into the pores and grains of the concrete surface. However in the case of the present invention, the burnt on stains and dirt is removed by the mechanical abrasive action of the abrasive agent (in this case fly ash) and the other ingredients of the composition playing a supportive role. Thus the referred patent is different from the present invention (fly ash based hard scouring cleaner) in terms of application, mode of application and composition. Therefore the present invention is totally different from the U.S. Pat. No. 5,990,067 in terms of application, mode of application and composition.

OBJECT OF THE INVENTION

The main object of the invention is to provide a scouring powder composition, which obviates the drawbacks as detailed above.

One more object of the invention is to provide a low foaming scouring powder.

Another object of the invention is to provide a process for preparing the composition.

Still another object of the present invention is to utilize abrasive character of fly ash for preparing abrasive agent for industrial applications.

SUMMARY OF THE INVENTION

Accordingly, the present invention relates to a cleaning powder composition and a process thereof. The present invention more specifically provides a scouring powder composition, 'Glitters', wherein fly ash, a waste product from thermal power stations is utilized as an abrasive agent along with other ingredients. This invention finds its usage as cleaning powder; especially used for removing stains/scorch marks and burnt-on dirt deposited over kitchen utensils and industrial vessels.

DETAILED DESCRIPTION OF THE INVENTION

Accordingly, the present invention provides a low foaming scouring powder composition, said composition comprising fly ash as an abrasive agent ranges between 40 and 75%, an surfactant ranges between 3 and 6%, an alkali metal carbonate ranges between 10 and 20%, an alkali metal bicarbonate ranges between 3 and 15%, an alkali halide ranges between 1 and 10%, clay ranges between 5 to 50% and optionally traces of perfumes and colors.

In an embodiment of the invention provides a scouring composition preferably comprising 2–8% by wt surfactant, 8–10% by wt sodium carbonate, 5–7 wt % sodium Bicarbonate, 10–15% by wt commercially available processed clay, 3–5% by wt sodium chloride and balance to 100 wt % of fly ash accompanied by traces of perfumes and colors.

Another embodiment of the invention provides a scouring composition wherein the surfactant is selected from group consisting of anionic, nonionic and amphoteric surfactant.

Still another embodiment of the invention provides low foaming scouring composition.

Still another embodiment of the invention, the fly ash is obtained from thermal power stations by burning coal or lignite.

Yet another embodiment of the invention, size of the fly ash used could be of any size fraction, but preferably about 150-$\mu$m.

In yet another embodiment of the invention, the alkali metal carbonate is selected from the group consisting of sodium carbonate, potassium carbonate and lithium carbonate.

In yet another embodiment of the invention, the alkali metal bicarbonate is selected from the group consisting of sodium bicarbonate, potassium bicarbonate and lithium bicarbonate.

Yet another embodiment of the invention, the alkali halide is selected from group consisting of sodium chloride, potassium chloride and lithium chloride.

In yet another embodiment of the invention relates to type of clays used, which is selected from group consisting of talc, processed clay, bentonite clay, mud clay, china clay and any other commercially available clay.

Yet another embodiment of the invention, the said scouring composition removes stains, scorch marks, polishing and burnt-on dirt deposited over kitchen utensils and industrial vessel/components.

Yet another embodiment of the invention, the said scouring composition exists in the form of solid, gel, solution, paste and powder.

In yet another embodiment of the invention, the said scouring composition is used for cleaning concrete surfaces.

In another embodiment of the invention, the fly ash can be used for industrial applications as abrasive wheel abrasive clothes and abrasive papers.

One more embodiment of the invention provides a process for the preparation of scouring powder composition, said process comprising of:

(a) mixing the surfactant, sodium carbonate and sodium bicarbonate in a paddle mixer, under constant stirring at a temperature ranging between 50 to 60° C.;

(b) transferring the resultant mixture to a homogeniser and adding processed clay, bentonite clay, sodium chloride, fly ash and optional ingredients like colors and perfumes one by one within the time gap of 10 minutes after each addition the mixture is stirred; and (c) continuing the mixing the above ingredients for 10 to 20 minutes till the mass becomes homogeneous and discharging from the homogenizer for packing.

Another embodiment of the invention, the paddle mixer used for mixing the scouring composition is jacketed type equipped with circulatory cooling system for maintaining uniform temperature of the mixer, water is circulated through to maintain the temperature.

Still another embodiment of the invention, wherein in step (b) the ingredients are preferably, added in sequence i) sodium chloride; ii) commercially available processed clay; iii) fly ash; iv) colors; and v) perfumes.

In a water-jacketed paddle mixer, acid slurry, sodium carbonate and sodium bicarbonate are mixed. Acid slurry reacts with sodium carbonate and bicarbonate to produce sodium salt of benzene sulphonic acid. Water is passed through jacket in controlled manner so to maintain the temperature of the mass around 50 to 60 degree Celsius. The mass is stirred for about 15 minutes and then discharged. The mass is then allowed to cool to room temperature and then transferred to a homogeniser such as edge running mixer. The remaining ingredients are then added one by one with 10 minutes' gap after each addition, with continuous mixing in the following sequence: i) sodium chloride; ii) commercially available processed clay; iii) fly ash; iv) color and v) perfume. Mixing is then continued till the mass becomes homogeneous. This usually takes another 15 to 20 minutes. Scouring powder so produced is discharged from the homogeniser and stored for packing and distribution.

In an embodiment of the present invention, preferred ranges of ingredients for the composition can be: Surfactant—2 to 8 wt %; Sodium Carbonate—8 to 10 wt %; Sodium Bicarbonate—5 to 7 wt %; Commercially available processed clay—10 to 15%; Sodium Chloride—3 to 5 wt % and balance to 100 wt % of fly ash accompanied by traces of perfumes & colors.

In another embodiment of the present invention, the surfactant component comprises of at least one anionic, nonionic or amphoteric surfactant.

In yet another embodiment of the present invention, the scouring powder is low foaming.

In still another embodiment of the present invention, any size fraction of fly ash can be used.

Accordingly the present invention provides a process for production of scouring powder composition which comprises of mixing the surfactant, sodium carbonate and sodium bicarbonate in a paddle mixer, having arrangement for constant stirring and cooling the mixer so as to maintain the temperature of the mixer within the range of 50 to 60 degree Celsius; transferring the resultant mixture, at room temperature, to a homogeniser; adding other ingredients (commercially available processed clay, sodium chloride, fly ash and colors & perfumes) one by one (within the time gap of 10 minutes after each addition) to the mixture in the homogeniser, having arrangement for constant stirring; discharging the scouring powder at room temperature.

The novelty of the present invention resides in providing a scouring powder composition, utilizing fly ash as an abrasive agent, major component of the composition, which is otherwise a waste product and hardly 3% of total fly ash produced in the world could only be utilized till to date. Thereby the pollution due to fly ash could be minimized. The resultant composition is useful as a cleaning agent both in domestic sector as well as industrial sector.

The above said novelty and usefulness has been achieved by the non-obvious scouring powder composition and inventive steps of the process of the present invention.

The following examples are given by way of illustration of the present invention and should not be construed to limit the scope of the present invention.

EXAMPLE-1

| | |
|---|---|
| Fly Ash | 64% |
| Anionic Surfactant | 6% |
| Sodium Carbonate | 20% |
| Sodium Bicarbonate | Nil |
| Processed Clay | 10% |
| Sodium Chloride | Nil |
| Colours and perfumes | Nil |

This composition contains the three essential ingredient viz. anionic surfactant, sodium carbonate and fly ash. Processed china clay was added to improve the abrasive action of fly ash and to lighten the color of the composition. Processed clay also lightened the color of the product. Scouring efficiency was tested on stained and scorched surfaces and found to be excellent.

EXAMPLE-2

| | |
|---|---|
| Fly Ash | 64% |
| Anionic Surfactant | 6% |
| Sodium Carbonate | 20% |
| Sodium Bicarbonate | Nil |
| Processed Clay | 10% |
| Sodium Chloride | Nil |
| Colours and perfumes | traces |

This composition was same as that of composition 1 except for addition of traces of detergent grade blue color. This gave the product a nice bluish gray color, which succeeded in masking the light gray color of composition 1. Scouring efficiency was excellent.

EXAMPLE-3

| | |
|---|---|
| Fly Ash | 70% |
| Anionic Surfactant | 5% |
| Sodium Carbonate | 15% |
| Sodium Bicarbonate | Nil |
| Processed Clay | 10% |
| Sodium Chloride | Nil |
| Colours and perfumes | Nil |

In this case the percentages of anionic surfactant and sodium carbonate were reduced to 5 and 15% respectively (with respect to composition 2). No substantial loss in scouring efficiency was observed in comparison to composition 1.

EXAMPLE-4

| | |
|---|---|
| Fly Ash | 70% |
| Anionic Surfactant | 3% |
| Sodium Carbonate | 10% |
| Sodium Bicarbonate | Nil |
| Processed Clay | 17% |
| Sodium Chloride | Nil |
| Colours and perfumes | Nil |

Percentages of anionic surfactant and sodium carbonate further reduced to 3 and 10% respectively. As proportion of fly ash was same as composition 3, abrasive efficiency remained same. However, dispersion was a bit reduced due to decrease in percentage of surfactant in the composition. Further, percentage of processed clay was increased to 17%. No substantial advantage of this increase was observed.

EXAMPLE-5

| | |
|---|---|
| Fly Ash | 55% |
| Anionic Surfactant | 5% |
| Sodium Carbonate | 15% |
| Sodium Bicarbonate | Nil |
| Talc | 10% |
| Bentonite | 5% |
| Processed clay | 5% |
| Sodium chloride | 5% |
| Colour & Perfume | Nil |

In this case, a mixture of talc, bentonite and processed clay replaced 17% of processed clay in composition 4. Talc was added to act as lubricant during the cleaning process. Bentonite has higher water absorption capacity than processed clay and this property was explored by partial replacement of processed clay with bentonite. Due to this, marginal advantage over processed clay vis-a-vis synergistic action, was observed. However, color of the product acquired a brownish tinge due to addition of bentonite. Sodium chloride was added to retain traces of moisture so as to reduce dustiness of the product, which was found to decrease in practical terms.

EXAMPLE-6

| | |
|---|---|
| Fly Ash | 45% |
| Anionic Surfactant | 5% |
| Sodium Carbonate | 10% |
| Sodium Bicarbonate | 5% |
| Talc | 20% |
| Bentonite | 10% |
| Sodium Chloride | 5% |
| Colour & Perfume | Nil |

In this case, talc and bentonite were added with total exclusion of processed clay. This was done to increase the marginal advantage obtained in composition 5. No further advantage vis-a-vis synergistic action was observed when compared to composition 5. But due to increased bentonite content, color of the product is rendered dirty brown, which reduces consumer appeal. No additional advantage was observed due to addition of talc. It was therefore decided to revert back to processed clay for further compositions. Sodium bicarbonate was added (5%) and percentage of sodium carbonate was reduced to 10%. The purpose of addition of sodium bicarbonate was with the idea that during mixing, due to reaction with acidic surfactant, greater amount of carbon dioxide could be released, leading to a lighter product. This was actually found to be so. Scouring effect was excellent.

EXAMPLE-7

| | |
|---|---|
| Fly Ash | 65% |
| Sodium Carbonate | 10% |
| Anionic Surfactant | 5% |
| Sodium Bicarbonate | 5% |
| Processed Clay | 10% |
| Sodium Chloride | 5% |
| Colours & Perfume | Nil |

As decided at the end of the experiment 6, talc and bentonite were rejected and processed clay was brought back into the composition. Scouring efficiency was found to be excellent.

EXAMPLE-8

| | |
|---|---|
| Fly Ash | 60% |
| Anionic Surfactant | 5% |
| Sodium Carbonate | 10% |
| Sodium Bicarbonate | 5% |
| Processes Clay | 10% |
| Sodium Chloride | 5% |
| Colour & Perfume | Traces |

Traces of detergent grade color were added to composition 7. Small quantities of the above composition were randomly distributed to ten actual users for trial. Feed back received was good and this composition was taken as optimized composition.

TABLE 9

| | Compositions examples 1 to 8. | | | | | | | |
|---|---|---|---|---|---|---|---|---|
| | 1 | 2 | 3 | 4 | 5 | 6 | 7 | 8 |
| Fly Ash | 64 | 64 | 70 | 70 | 55 | 45 | 65 | 60 |
| Anionic Surfactant | 6 | 6 | 5 | 3 | 5 | 5 | 5 | 5 |
| Sodium Carbonate | 20 | 20 | 15 | 10 | 15 | 10 | 10 | 10 |
| Sodium Bicarbonate | — | — | — | — | Nil | 5 | 5 | 5 |
| Processes Clay | 10 | 10 | 10 | 17 | 5 | — | 10 | 10 |
| Talc | — | — | — | — | 10 | 20 | — | — |
| Bentonite | — | — | — | — | 5 | 10 | — | — |

TABLE 9-continued

| | Compositions examples 1 to 8. | | | | | | | |
|---|---|---|---|---|---|---|---|---|
| | 1 | 2 | 3 | 4 | 5 | 6 | 7 | 8 |
| Sod. Cl | — | — | — | — | 5 | 5 | 5 | 5 |
| Color & perfume | — | Traces | — | — | nil | Nil | Nil | Traces |

The Main Advantages of the Present Invention are:

1. Use of fly ash as an abrasive agent reduces the cost of production of scouring powder in comparison to the scouring powders already available in the market.
2. As per international standard the size of mineral abrasion agent in scouring powder should be less than 0.15 mm. Other abrasive agents in the prior art have to be ground to <0.15 m, an operation that is occupationally hazardous. Since the particle size of fly ash is 150 um, no extra grinding is required to meet the international standard.
3. Scouring efficiency of the resultant composition is as good as other scouring powders available in the market.

What is claimed is:

1. A process for production of scouring powder composition, said process comprising of:

(a) mixing the surfactant, sodium carbonate and sodium bicarbonate in a paddle mixer, under constant stirring at a temperature ranging between 50 to 60° C.;

(b) transferring the resultant mixture to a homogeniser and adding processed clay, bentonite clay, sodium chloride, fly ash and optional ingredients like colors and perfumes one by one within the time gap of 10 minutes after each addition the mixture is stirred; and (c) continuing the mixing the above ingredients for 10 to 20 minutes till the mass becomes homogeneous and discharging from the homogenizer for packing.

2. The process as claimed in claim 1, wherein the paddle mixer is equipped with circulatory cooling system for maintaining uniform temperature of the reaction.

3. The process as claimed in claim 1 wherein water is circulated through the circulatory system.

4. The process as claimed in claim 1, wherein in step (b) the ingredients are added sequentially i) sodium chloride; ii) commercially available processed clay; iii) fly ash; iv) colors; and v) perfumes.

* * * * *